US005524359A

United States Patent [19]

Averbeck et al.

[11] Patent Number: 5,524,359

[45] Date of Patent: Jun. 11, 1996

[54] METHOD FOR TREATMENT OF A FABRIC AND AN ASSEMBLY TO PERFORM SUCH A METHOD

[75] Inventors: Ludger Averbeck, Münster; Werner Schlickmann, Coesfeld, both of Germany

[73] Assignee: Thies GmbH & Co., Coesfeld, Germany

[21] Appl. No.: 317,439

[22] Filed: Aug. 10, 1994

[30] Foreign Application Priority Data

| | | | |
|---|---|---|---|
| Aug. 23, 1993 | [DE] | Germany | 43 28 256.3 |
| Sep. 3, 1993 | [DE] | Germany | 43 29 844.3 |
| Jul. 25, 1994 | [DE] | Germany | 44 26 336.8 |

[51] Int. Cl.[6] ..... F26B 13/00

[52] U.S. Cl. ..... 34/362; 34/585; 8/149.2; 8/151

[58] Field of Search ..... 8/149.2, 149.1, 8/151, 152; 68/177, 178, 184, 62; 34/320, 362, 413, 585

[56] References Cited

U.S. PATENT DOCUMENTS

| | | | |
|---|---|---|---|
| 3,685,325 | 8/1972 | Carpenter | 68/177 |
| 3,718,012 | 2/1973 | Vinas | 68/177 X |
| 4,468,937 | 9/1984 | Bertoldi | 68/177 X |
| 4,766,743 | 8/1988 | Biancalani et al. | 68/177 |
| 5,243,840 | 9/1993 | Grafen et al. | 68/177 |

*Primary Examiner*—Frankie L. Stinson
*Attorney, Agent, or Firm*—Meltzer, Lippe, Goldstein et al.

[57] ABSTRACT

A method is described for the treatment of a fabric comprising the introduction of a certain length of the fabric into a treatment device, making an endless loop from the piece of fabric and transporting the loop of fabric within the treatment device. The loop of fabric is subjected during its transport to a certain mechanical and/or heat treatment with the result that in particular the volume, the touch, the surface appearance or the water content of the loop of fabric are specifically changed, and whereby it is possible to adjust the pressure inside the treatment device higher or lower than the ambient temperature.

An assembly for the performance of the method comprises a treatment device, in the form of an autoclave which is airtight and closed on all sides. The autoclave comprises to a feeding opening which can be closed gastight and a transport device, whereas the treatment device comprises a source to produce an increased or a decreased pressure.

38 Claims, 3 Drawing Sheets

METHOD FOR TREATMENT OF A FABRIC AND AN ASSEMBLY TO PERFORM SUCH A METHOD

Figure 1:
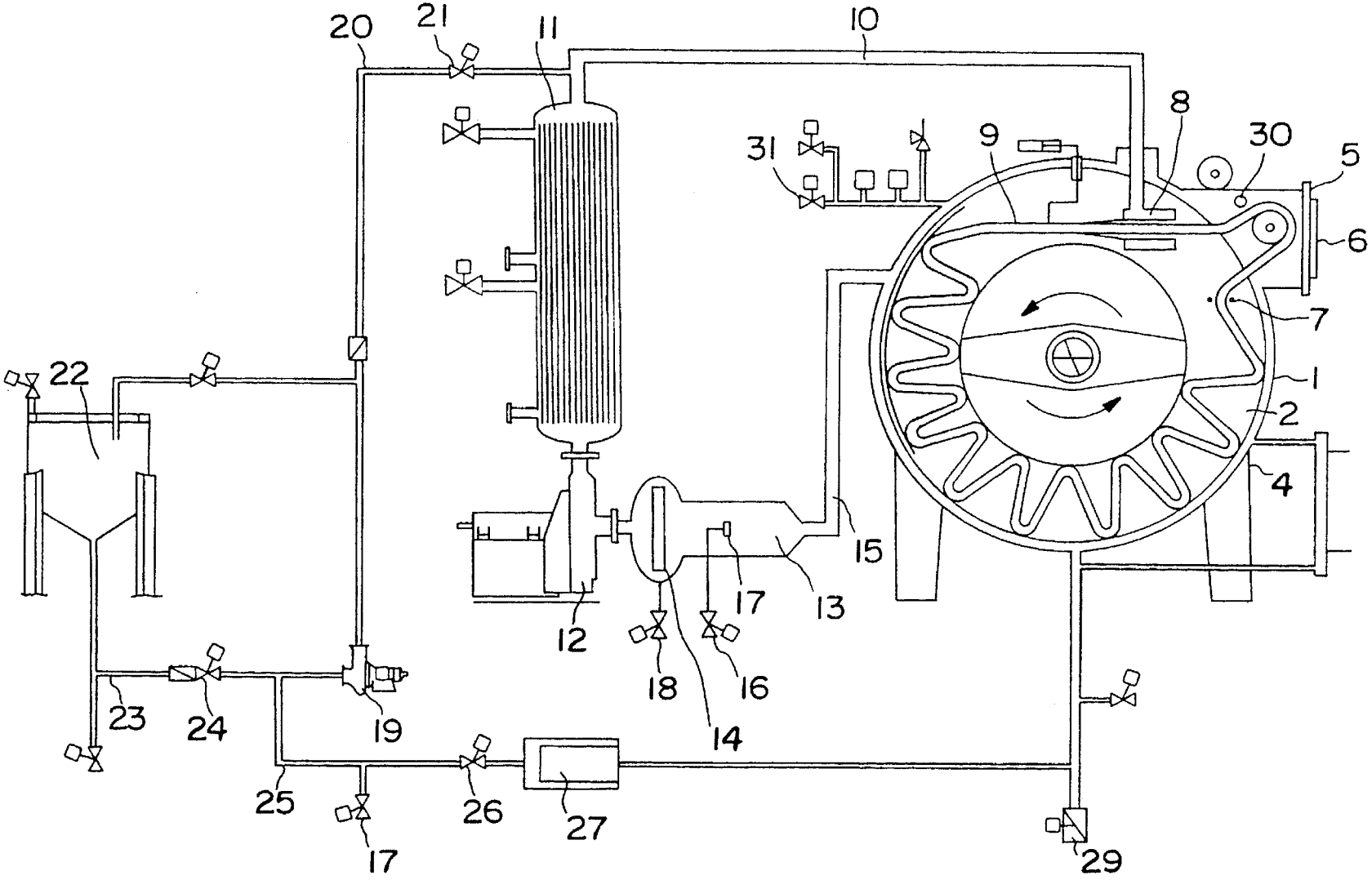

The present invention relates to a method for treatment of fabric with the features of the general part of claim 1 and an assembly to perform such a method.

For the finishing of textile a number of methods are known to treat fabric and to change by doing so the properties of materials incorporated in the fabric. It is for instance possible to perform a treatment of fabric by arranging a predetermined length of the fabric inside a treatment device. From the fabric an endless loop is made by the connection of both exterior parts of the fabric, such that the loop may comprises a total length between 50 and 800 m, depending on the dimensions of the treatment device. Within the treatment device the loop of fabric is transported for a certain period of time, which represents nothing else than that the fabric is subjected to a continuous treatment over its whole length by the connection of the two exterior parts and the subsequent generation of the loop of fabric.

The best known method of treatment of a fabric in the form of an endless loop of fabric should be the method of dyeing in the form of a rope, which comprises the contact between a rope of a loop of fabric with a dyeing liquor within a treatment device for a predetermined period of time, in order to obtain at the end of the treatment a homogeneously dyed fabric.

In order to change at the finishing of textile in a specific manner the volume, the feel (touch), the surface appearance or the water content of a fabric, it is usual to feed the fabric to be treated over its complete width and continuously to a device for open width treatment. At such an open width treatment the fabric is subjected to a treatment over its full width at the same time, in order to prevent the unwanted generation of folds in particular lengthwise folds, which are later difficult to remove and represent a quality defect. Examples of such open width treatments leading to a change in volume, feel, surface image or the water content are the known methods of milling, fracturing, washing and relaxation, napping and drying, all of these methods being performed at the fabric over the entire width of the fabric. Such continuous open width treatments have the disadvantage, that it is only possible to perform them in a faultless manner at ambient pressure, since the locks, which would be required at the inlet and the outlet of the open width treatment device when working with increased or decreased pressure, did not show the required faultless way of working under real working conditions.

It was the aim of the present invention to provide a method for treatment of a fabric which makes it possible to treat a loop of fabric (ring of fabric) especially with respect to the production of a perfect quality product and the improvement of the changes in properties it produces.

This aim is met by a method with the characteristic features of claim 1.

In the inventive method for the treatment of a textile fabric a predetermined length of the fabric is arranged within a treatment device. Once inside the treatment device an endless loop of fabric is generated by the connection in particular by sewing of the end (exterior) parts of the length of fabric. This endless loop of fabric is then transported within the treatment device for a certain period of time. During the transport of the loop of fabric within the treatment device the loop of fabric is subjected to a mechanical and/or heat treatment with the consequence that by this mechanical and/or heat treatment in particular the volume, the feel (touch), the surface appearance and/or the water content of the loop of fabric is changed. This continuous but batch-wise treatment of the loop of fabric is performed according to the inventive method at a pressure, which is alternatively higher or lower than the respective ambient pressure.

It could surprisingly be observed, that the previously described inventive method brings about a number of changes in the properties of the fabric, which cannot be brought about by the known methods at all or only partly. It could be seen, that compared to known open width treatments the use of the inventive method significantly increases the volume of a fabric in a number of differently constructed fabrics, which is evident for instance from the significantly increased thickness of the fabric, a substantial increase in crimp and a substantial decrease in length and width of the products treated with the inventive method in comparison the known methods. Products treated with the inventive method also possess a markedly more pleasant and smoothly falling touch in comparison with the known methods and do not exhibit any unwanted folds or flexures, although it is necessary to store the loop of fabric in a folded way during its transport in the treatment device due to its length.

The advantages described above for the inventive method are particularly obvious, when the inventive method is used at the same time for tumbling and drying in particular at a pressure which is higher than the ambient pressure. This is thought to be due to the fact, the use of the increased pressure leads to a substantial increase in the drying-respectively tumbling-temperature of the fabric in comparison with a standard treatment, with the consequence that a larger shrinkage is brought about, which thereupon leads to the previously mentioned increased volume, increased homogeneity of fabric surface appearance and improved touch. Due to the fact, that at least during the initial phase at such a tumbling and drying there is within the fabric a sufficient amount of humidity to allow the yarn systems within the fabric to move freely relative to each other, since said amount of humidity functions as a lubricant an furthermore the mechanical treatment of the fabric during the inventive method stimulates this movement which makes the in particular very smooth fabric surface appearance after the simultaneous tumbling and drying understandable. It is on the whole understandable, that the fabric simultaneously tumbled and dried according to the inventive method provides a markedly more pleasant, smoother falling and more voluminous touch, in particular since the inventive method makes it possible to apply during the tumbling and drying suitable treatment products, as will be described hereafter and/or adjust the fabric to a certain final humidity.

It is also possible to perform the inventive method with a small number of staff, in particular since it is not required other than in continuous open width treatments to control the transport of the fabric loop within the treatment device. For that reason the inventive method can be performed in a much more economic manner compared with conventional methods.

Depending on the respective design of the treatment device used in the inventive method the loop of fabric transported within the treatment device can also be transport in an arrangement over its width. However, it is particularly suitable with respect to the final quality of the fabric, such as the volume increase, the improvement in touch and/or the change and in particular the increased homogeneity of the fabric surface appearance, to transport the loop of fabric within the treatment device in the form of a rope.

There are several possibilities for the transport of the loop of fabric according to the inventive method. It is possible to transport the loop of fabric by the contact with a rotating driving element. This element may have the form of a reel, of at least one driving roller and/or at least one pair of driving rollers depending on the type of fabric to be treated.

Further to the above-described driving element or instead of the above-described driving element the transport of the fabric within the treatment device can be performed in such a manner, that the loop of fabric is fed through a nozzle perfused by a gaseous fluid in particular by air or steam. The choice for this way of transport of the loop of fabric through a nozzle perfused by a gaseous fluid is preferably taken always when a fabric has to be treated according to the inventive method which is sensitive for surface damage (surface rubbing).

As has been mentioned before, the loop of fabric can during its treatment in the treatment device be subjected to a treatment with at least one treatment product. Depending on the changes wanted from the inventive method. The selection of this treatment product and the way to apply it depend on the property changes wanted from the inventive method.

For instance it is possible with the inventive method, to apply, or rather spray, a liquid treatment product on the fabric. It is also possible to contact the fabric for a short period of time with a liquor present at the bottom of the treatment device and containing a said treatment product.

If it is necessary to apply the treatment product particularly homogeneously over the width and the length of the fabric, then it is possible to use a gaseous or smoke-like (fog-like) treatment product, which method is in general particularly preferred.

A further embodiment of the previously described variation of the inventive method applying a gaseous or smoke-like treatment product provides the application of this gaseous or smoke-like treatment product within the nozzle on the fabric. According to this embodiment of the inventive method the function of the nozzle perfused by the gaseous fluid, in particular by air or steam, is not only to transport the loop of fabric within the treatment device, but also for the application of the gaseous or smoke-like (fog-like) treatment product. This leads on the one hand to a faultless transport of the fabric by the increased density of the fluid responsible for the transport of the fabric in the nozzle and on the other hand a particularly homogeneous application of the treatment product on the fabric. The treatment product can be led to the nozzle independently from the fluid, so that the treatment product is brought in a gaseous or smoke-like state and applied as such onto the fabric. It is particularly suitable to add the treatment product to the liquid fed to the nozzle, which has as a consequence, that the gaseous or smoke-like treatment product is mixed with the liquid, preferably air or steam, before reaching the nozzle.

Treatment products in the sense of the inventive method are all substances or substance mixtures, which can change the properties of a fabric in a specific manner. Treatment products can be water or aqueous solutions, aqueous dispersions or suspensions of certain chemicals, in particular of softening agents, hydrophilising agents, hydrophobising agents, oleophilising agents, oleophobising agents, antistatic agents, touch preparations (lubricants) and/or antislip agents. The term gaseous treatment products represents such treatment products which are gaseous under the conditions of their application on the fabric, however preferably turning into liquid or solid treatment products after they arrive on the surface or the inside of the fabric.

The treatment temperature within the treatment device is chosen depending on the treatment effects wanted. In general the treatment temperature varies between 80° C. and 150° C., in particular between 105° C. and 140° C., the latter temperatures being preferably used, when the inventive method is used for simultaneous tumbling and drying.

If the inventive method is performed at a pressure which is higher than the ambient pressure, then preferably a pressure between $1.5\times10^5$ Pa and $4\times10^5$ Pa is chosen, and if the inventive method is performed at a pressure lower than the ambient pressure, then a pressure between $0.01\times10^5$ Pa and $0.8\times10^5$ Pa is chosen.

It is a particularly suitable embodiment of the inventive device to treat the loop of fabric within the treatment device at a variable treatment pressure. In a first phase of this embodiment the pressure in the treatment device is reduced to a pressure lower than the ambient pressure. After a certain first period, varying between about 2 min and about 40 min, preferably between about 10 min and about 20 min, a second treatment phase begins, during which the fabric is treated at a pressure which is higher than the ambient pressure. The treatment period in the second phase varies between about 4 min and about 80 min, preferably between about 10 min and about 40 min. This embodiment of the inventive method is particularly suitable for an even distribution of the previously mentioned treatment product over the thickness of the fabric, in particular since a thorough deaeration takes place during the treatment phase at a lower pressure than the ambient pressure.

It is evident that it is possible, to perform the previously described first and second phase repeatedly after one another in order to reach an even better and more homogeneous distribution of the treatment fabric over the thickness of the fabric.

The pressure in the first phase varies between $0.01\times10^5$ Pa and $0.8\times10^5$ Pa and the pressure in the second phase varies between $1.5\times10^5$ Pa and $4\times10^5$ Pa.

The total treatment time in the inventive method depends on the property changes wanted, in particular with respect to the volume, the touch, the fabric surface appearance and/or water content of the fabric. Usually the treatment time varies between 5 min and 120 min, preferably between 20 min and 80 min.

The transport speed of the loop of fabric during its treatment within the treatment device depends on the wanted effect of the treatment. Usually the loop of fabric is transported during the treatment in the treatment device with a speed between 50 m/min and 1000 m/min, in particular between 200 m/min and 400 m/m.

As has been repeatedly said, the inventive method can be used for different types of treatment depending on the type of fabric and the previously parameters. It is for instance possible, to use the inventive method to increase the volume, to improve the touch, to apply finishing chemicals, to change the surface appearance of the fabric and/or change material composition of the treated fabric. Particularly good results are obtained with the use of the inventive treatment, when the inventive method leads to an increase in volume or an improvement in touch in such a manner, that the fabric treated according to the inventive method now possesses a loose and easy falling touch.

The improvement in the surface appearance of the fabric does not only mean the increased homogeneity of the surface appearance but also such effects directed at certain specific and wanted folds on the surface of the fabric, leading for instance to such articles which are called "crash articles". It is also possible to use the method in jeans wear, giving the fabric an appearance which is usually called "stone washed" in the textile business.

Yet another possibility is the wanted specific pile displacement in terry cloth or velour articles. It is however particularly suitable, to use the inventive method for the tumbling and/or drying of fabric, in particular for the simultaneous tumbling and drying of fabric, whereby it is preferred to condition the dried fabric at a final water content which varies depending on the respective article in particular between 1% by weight and about 12% by weight (weight water:weight article).

The present invention further relates to an assembly for the performance of the above-described inventive method.

The inventive assembly for the performance of the above-described method comprises a treatment device in the form of an autoclave, in particular as a cylindrical autoclave, closed on all sides and airtight. Said autoclave comprises an opening for feeding the fabric and its removal and a transport device for the fabric on the inside. The treatment device is connected with a pressure source which can generate increased and decreased pressure inside the autoclave, with the consequence that the previously described treatments can be performed at pressures which are above or below the ambient pressure.

The inventive assembly provides a number of advantages. The inventive assembly requires relatively little space, which is definitely less than the space required by a conventional open width treatment machine. This economy in space is due to the fact, that the inventive assembly allows the treatment of a loop of fabric, this loop of fabric being transported during the treatment within the treatment assembly. Since it is not necessary to check the movement of the loop of fabric during the treatment according to the inventive method, a number of the inventive assemblies can be controlled by one single operator, which is a major economic advantage. Furthermore it is possible to obtain particularly advantageous and various property changes of the fabric treated in this manner, as was already described above at the inventive method.

With respect to the transport device contained in the inventive assembly there are several possibilities.

According to a first embodiment of the inventive assembly the transport device comprises a driving element slung by the fabric, whereby this driving element has the form of a driven reel, at least one driven roller or at least one pair of driven rollers. The choice of said driving elements (reel driving roller or pair of driving rollers) depends on which fabric is to be treated on the inventive assembly. With fabric of relatively low sensitivity, meaning such fabric which has little or no tendency to show surface damages, the transport device can exist of only one reel slung by the fabric, whereas in more sensitive fabric it is preferable to use driving rollers or pairs of driving rollers.

The angular deflection of the fabric around the aforementioned driving elements varies between 70° and 300°, preferably between 85° and 240°.

According to a further embodiment of the inventive assembly the transport device contains additionally to the previously described driving element or instead of said driving element a nozzle perfused by a gaseous liquid. It is the effect of this nozzle to transport the fabric by the movement of the streaming gaseous liquid, which is preferably air or steam, in the direction of the exit of the nozzle, which leads to a transport of the fabric.

In order to adjust the movement of the fabric to a reproducible speed, it is to be preferred to give the nozzle the form of a nozzle canal, since in this way the fabric is subjected longer to the driving pressure of the gaseous liquid. This leads to certain jolting or flapping movements of the fabric in particular in cases where the fabric is dry or contains only a relatively limited final humidity, for instance between 40% by weight and 10% by weight.

In order to enable a faultless deposition of the fabric within the treatment device it is a preferred embodiment to assign to the exit of the nozzle or behind the driving element (in view of the transport direction of the fabric) an element for cloth folding of the fabric.

According to a further particularly suitable embodiment of the inventive assembly the transport device, which may be the driving element and/or the nozzle, comprises at least one free rotatable cylindrical drum constructed within the cylindrical autoclave. Said drum exists of two axially adjacent and mutually aligned drum halves, which are constructed at such a distance from each other, that there is a gap between the drum halves over the whole area of the outer surface (shell) of the drum. In this way the fabric is transported behind the driving element or behind the nozzle (in transport direction) through the gap in the surface of the drum into the inside of the drum and deposed there, so that the weight of the fabric makes the within the autoclave freely rotatable drum turn, with the consequence, that the fabric is transported by this turning of the drum into the direction of the driving element or the nozzle.

According to a further embodiment of the inventive assembly an element for cloth folding is connected to the driving element or the nozzle in such a way, that the fabric is led during its transport in the treatment device through the gap into the inside of the drum an is there deposed by the element for cloth folding. Such a measure is of importance for the faultless transport of the fabric within the inventive assembly.

In the embodiments of the inventive assembly which comprise a nozzle canal it is possible to construct the final part of the nozzle canal in such a pivotable manner, that this final part of the nozzle canal is at the same time the element for the cloth folding of the fabric.

Any number of drums can be present in the inventive assembly, said number depending only on the wanted size of the inventive assembly. Preferably the inventive assembly contains one to eight, in particular two to four drums on the inside, which then makes it possible to treat in such an assembly one to eight, preferably two to four loops of fabric at the same time.

In the embodiments of the inventive assembly which comprise in the transport device a nozzle or a nozzle canal, it is possible to circulate the gaseous fluid required for the transport of the fabric in an economic manner by the assignment to the nozzle of a feeding system connected with a ventilator (fan).

In particular when the feeding system is connected with the treatment device in such a manner that the gaseous liquid is sucked off from the treatment device and is fed again to the treatment device through the nozzle or the nozzle canal a particularly economic and stable treatment is possible in the inventive assembly. This is connected with the fact, that in particular when the inventive treatments are performed at an increased temperature or a specific humidity no complicated controlling system is required, since the gaseous liquid sucked from the treatment device exhibits more or less the required temperature and humidity, so that only little adjustments are required, to reintroduce the gaseous liquid with adjusted temperature and humidity to the nozzle or the nozzle canal.

It is an advantage to provide the previously described feeding system with a filter, an exit pipe (duct) connected with a first valve, an feeding pipe (adduct) connected with a second valve for the gaseous fluid and/or a treatment product and/or a heat exchanger. Such a construction makes it possible to drain the gaseous liquid partly or completely, to add fresh gaseous liquid partly or completely, to add a treatment product in the sense of the way previously described at the method and/or increase or decrease the temperature.

If it is required to bring the loop of fabric in contact with a liquor containing the treatment product then it is an embodiment of the previously described variations of the inventive assembly to add a second feeding system, containing a pump for the circulation of the liquids, this second feeding system comprising a filter, a heat exchanger and/or at least one supply for said treatment product.

In particular in such embodiments of the inventive assembly which contain relatively large autoclaves it is preferred to connect to the treatment device a circulation means and/or heating device, said device being optionally connected within the autoclaves or outside the autoclaves.

There are different possibilities to produce a pressure or a vacuum within the autoclaves according to the inventive assignment. It is for instance possible to build up an increased or decreased pressure within the autoclaves by the connection of the autoclave with a separate ventilator through a respective feeding system. If the inventive assembly comprises the previously described nozzle or nozzle canal then it is preferred to connect the feeding system to the autoclave in such a manner, that the ventilator, which is present anyway to feed the nozzle or the nozzle canal with the gaseous liquid, is used at the same time to produce an increased or decreased pressure in the autoclave.

Advantageous embodiments of the inventive method as well as the inventive assembly are given in the subclaims.

Figure 2:
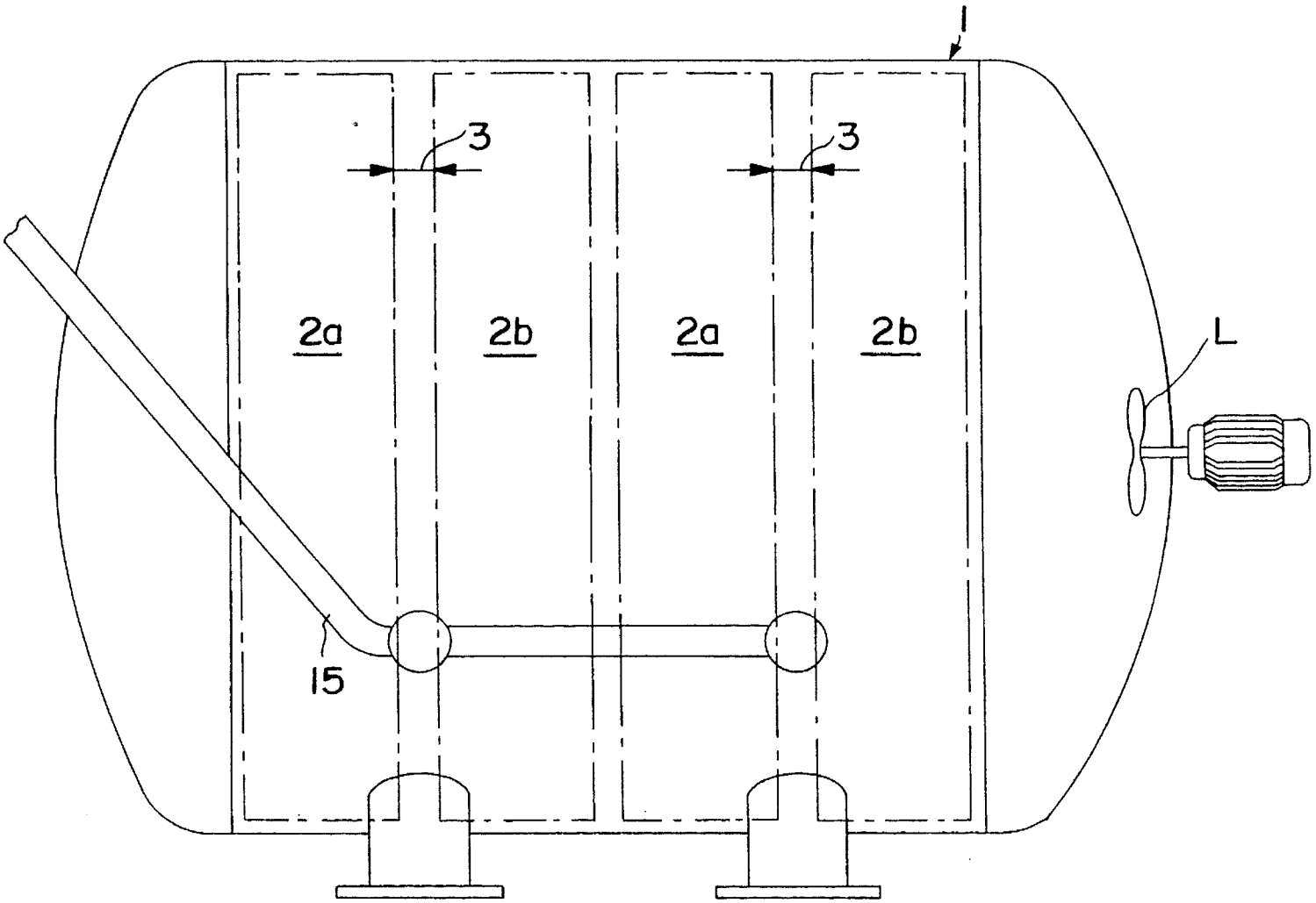

The above-described assembly is further illustrated by the two following examples. They show:

FIG. 1 a schematic view of a first embodiment of the assembly;

FIG. 2 a schematic side view of the embodiment shown in FIG. 1 and

Figure 3:
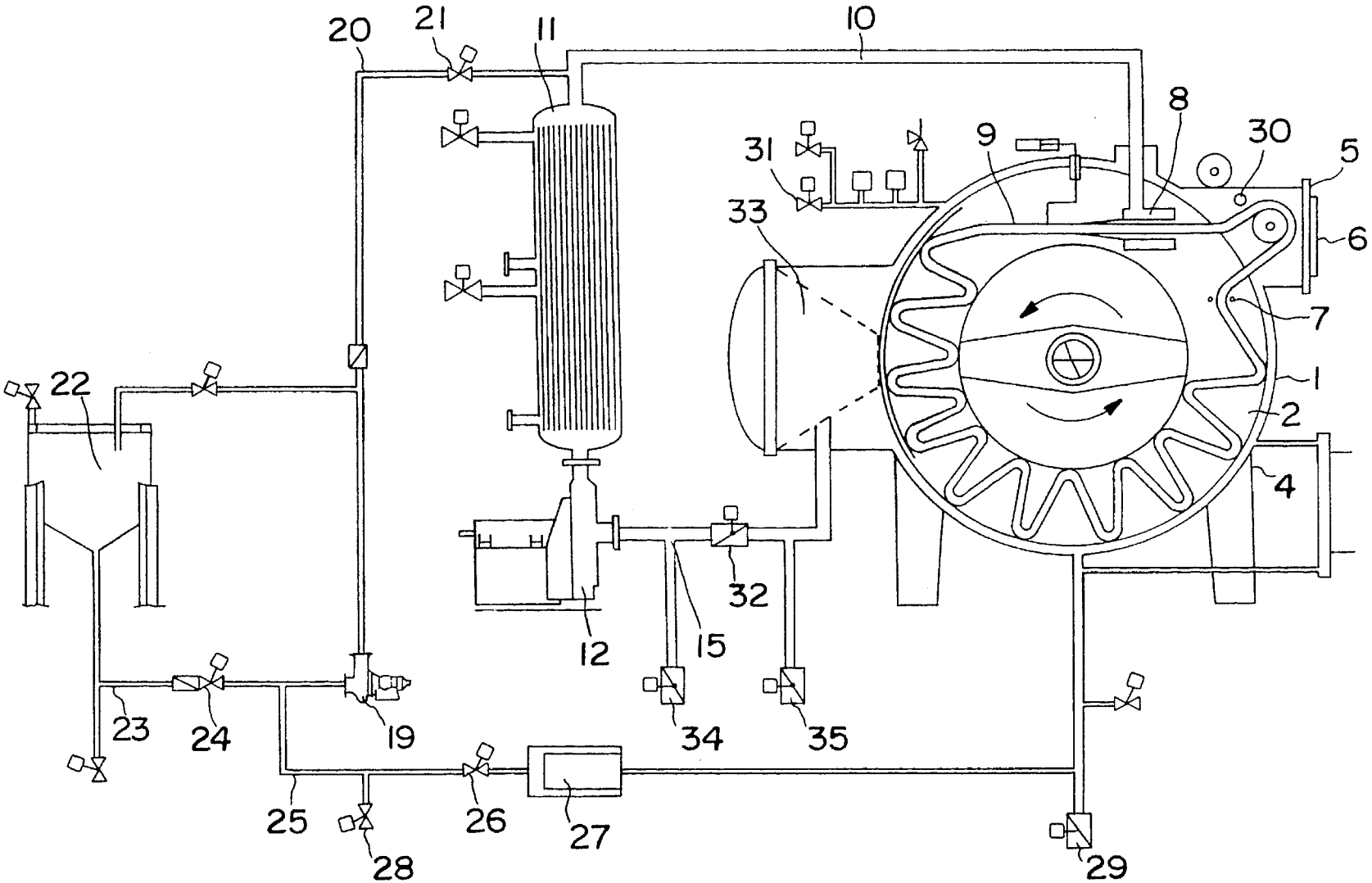

FIG. 3 a schematic view of a second embodiment of the assembly.

The assembly shown in FIGS. 1 and 2 is used for tumbling and drying under increased pressure, whereas the assembly shown in FIG. 3 is mainly used for tumbling under increased pressure and drying under normal pressure.

The assembly shown in FIGS. 1 and 2 comprises a treatment device in the form of a cylindrical autoclave 1, closed on all sides and airtight. Within the autoclave two freely rotatable cylindrical drums 2 are present, as can best be seen in FIG. 2. Both drums comprise drum halves 2*a* and 2*b*, whereby these drum halves 2*a* and 2*b* are assigned at a distance from each other so building a gap 3. At the front sides each drum is closed with a respective perforated metal part.

As can best be seen in FIG. 1, the autoclave 1 contains in its upper part 5, which is an extension of the autoclave 1, a reel 6 which is motor-driven and is slung by the loop of fabric 4 with an angular deflection of about 180°. In the transport direction of the fabric 4, indicated by the arrow, a nozzle 8 is arranged behind the reel 6, said nozzle 8 having the form of a nozzle canal and containing a feeding and treatment area 9. In the transport direction of fabric 4 a leading ring 7 is assigned before the reel 6, with the purpose to increase the angular deflection of the fabric 4 around the driven reel 6. The afore described leading ring 7 can also be arranged behind the reel 6 and in front of the nozzle 8. If the application of a liquor to the loop of fabric 4 is wanted it is possible to provide the leading ring with a number of apertures whereby these apertures are connected via not shown ducts to a supply container.

Above the reel 6 a roll 30 is assigned which can optionally be put into contact with the loop of fabric 4, in such a way that the friction between the reel surface and the fabric is increased and on the other side the loop of fabric can be squeezed between the roll 30 and the reel 6.

The transport of the loop of fabric within the autoclave is as follows:

Initially a predetermined length of the fabric is drawn over the reel and/or the nozzle into the autoclave through the feeding opening which is not shown. After the sewing together of the end (exterior) parts of the fabric the feeding opening is closed and the now formed loop of fabric is transported within the autoclave 1. The transport of the loop of fabric is in the direction of the arrow.

The transport device consisting of the reel 6, optionally the roller 30, the nozzle 8, the nozzle canal 9 and the rotatably connected drum 2 make the loop of fabric 4 to be transported with a specific speed through the treatment device. Initially the loop of fabric is led to the nozzle over the free-wheeling reel 6, so that the result is a transport of the loop of fabric in the nozzle 8 by the action of the gaseous liquid in the direction of the nozzle canal 9. Due to the fact that one end part of the nozzle canal 9 is turnable and in particular pivotable this end part of said nozzle canal 9 leads the loop of fabric through the gap 3 (FIG. 2) inside the drum 2 and folds it there. Due to the weight of the folded loop of fabric the drum 2 is turned in the direction of the arrow, with the consequence that the respective region of the loop of fabric is led into the direction of the ring 7 and the reel 6.

To feed the nozzle 8 with the gaseous liquid and so transport the loop of fabric through the nozzle, a duct 10 is connected to the nozzle 8 and the piece of nozzle canal 9, which duct 10 is connected on its other end over a heat exchanger with the pressure side of a ventilator. The sucking end of the ventilator is connected over a cooling/washing device 13 with a separator 14 and a duct 15 with the inside of the autoclave 1.

In the cooling/washing device 13 a liquid, in particular water, is injected directly in the stream of air/gas contaminated with lint flies through a valve 16 and a nozzle 17. The direction of injection being counter-current to the gaseous liquid. A cleaning of the gaseous liquid is the result, so that the separator 14 allows the draining of the contaminated liquid through a valve 18.

Instead of the afore described cleaning of the air/gas with the cooling/washing device 13 and the nozzle 17 it is also possible that the air/gas is cleaned by a filter 33 as it is described by the later embodiment in connection with FIG. 3.

If it would be necessary or wanted, the loop of fabric 4 can be subjected to a treatment with a treatment product through a pump 19, a duct 20, a valve controlling means 21. Said treatment product is led from a container 22 through the duct 23 and a valve 24 to the pump 19. Furthermore it is possible during the treatment to suck off an excess of treatment product through a duct 25, a valve 26 and a filter 27 from the autoclave 1 and led again this excess of treatment product to the sucking side of pump 19. A valve 17 in the duct 25 allows that further amounts of treatment product are added. If it would be necessary to remove an excess of treatment product from the autoclave 1, then it suffices to open valve 29.

Furthermore the autoclave contains at its front side a valve group 31, this valve group 31 having the service of a security valve and a ventilation valve, making it possible to adjust the autoclave optionally to an increased pressure, normal pressure and a reduced pressure.

If the loop of fabric 4 is to be treated by an increased pressure in the assembly shown in FIGS. 1 and 2, and in particular tumbled and dried, then this increased pressure can built up through the ventilator 12, the heat exchanger 11, the duct 10 and the nozzle 8 and/or with the help of an extern source of pressure in particular by a source of compressed air.

In order to adjust the relatively large autoclave 1 to a stable humidity and/or temperature, a fan L is assigned, which is to produce enough circulation of the air in the autoclave.

The embodiment shown in FIG. 3 is differing from the embodiments from FIGS. 1 and 2 only in so far as will be mentioned hereafter. Apart from that the design is identical and the same numbers are therefor used for corresponding parts.

The embodiment shown in FIG. 3 is mainly thought to tumble under increased pressure and to dry under normal pressure.

The duct 15, leading from the sucking side of the ventilator 12 to autoclave 1, contains different from the previously described embodiment a throttle-valve 32. Furthermore the duct 15 does not lead immediately to autoclave 1, but between autoclave 1 and duct 15 a filter 33 is connected, in an extended position from the autoclave.

The transport of the loop of fabric in the autoclave 1 is in FIG. 3 analogous to the previously described embodiment.

Whereas the tumbling and drying in the first embodiment was performed under increased pressure, the embodiment of FIG. 3 performs the drying of the loop of fabric 4 under normal ambient pressure the required air/gas stream is again led to the nozzle 8 or the nozzle canal 9 through the ventilator 12, the heat exchanger 11 and the duct 10. The humid air drawn from the autoclave and contaminated with lint flies is cleaned from lint flies by filter 33 and is led through duct 15 and throttle-valve 32 to the sucking side of ventilator 12. Depending on the position of throttle-valve 32, the position of fresh air valve 34 and the position of spent air valve 35 eventually a certain part of the humid spent air may be removed and replaced by a certain part of fresh air. Subsequently the spent air, cleaned and eventually mixed with fresh air, arrives at ventilator 12 and is led from there through the heat exchanger 11 and the duct 10 again at nozzle 8.

We claim:

1. A method of tumbling and/or drying a fabric, comprising introducing a predetermined length of said fabric in a treatment device, connecting two end parts of said fabric together so as to form said fabric into an endless loop, and transporting said loop of fabric through said treatment device while subjecting said loop of fabric to a treatment phase comprising tumbling and/or drying said loop of fabric for a predetermined period of time, thereby changing the volume, feel, surface appearance or water content of said loop of fabric in a specific manner, wherein said tumbling and/or drying in said treatment device is performed at a pressure between $0.01\times10^5$ Pa and $4\times10^5$ Pa and at a temperature between 80° C. and 150° C.

2. The method according to claim 1, wherein said loop of fabric is transported within said treatment device in rope form.

3. The method according to claim 1, wherein said loop of fabric is transported by contact with a rotating driving element arranged within said treatment device.

4. The method according to claim 1, wherein said loop of fabric is transported through a nozzle within said treatment device, said nozzle being perfused by a gaseous fluid.

5. The method according to claim 1, further comprising subjecting said loop of fabric to the influence of at least one treatment product during said treatment phase in said treatment device.

6. The method according to claim 5, wherein said treatment product is a gaseous or smoke-like treatment product.

7. The method according to claim 5, wherein said loop of fabric is transported through a nozzle within said treatment device, said nozzle being perfused by a gaseous fluid, and wherein said loop of fabric is subjected to the influence of said treatment product within said nozzle.

8. The method according to claim 7, wherein said treatment product is a component of said gaseous fluid perfusing said nozzle.

9. The method according to claim 1, wherein said tumbling and/or drying in said treatment device is performed at a temperature between 105° C. and 140° C.

10. The method according to claim 1, wherein said tumbling and/or drying in said treatment device is performed at a pressure between $1.5\times10^5$ Pa and $4\times10^5$ Pa.

11. The method according to claim 1, wherein said treatment and/or drying in said treatment device is performed at a pressure between $0.01\times10^5$ Pa and $0.8\times10^5$ Pa.

12. The method according to claim 1, wherein said treatment phase in said treatment device is performed during a first phase at a pressure which is lower than ambient pressure, and subsequently during a second phase at a pressure which is higher than ambient pressure.

13. The method according to claim 12, wherein the pressure during the first phase is between $0.01\times10^5$ Pa and $0.8\times10^5$ Pa, and the pressure during the second phase is between $1.5\times10^5$ Pa and $4\times10^5$ Pa.

14. The method according to claim 1, wherein said treatment phase is performed during a treatment period of between minutes and 120 minutes.

15. The method according to claim 1, wherein said treatment phase is performed during a treatment period of between 20 minutes and 80 minutes.

16. The method according to claim 1, wherein said loop of fabric is transported through said treatment device at a speed between 50 m/min and 1000 m/min.

17. The method according to claim 1, wherein said loop of fabric is transported through said treatment device at a speed between 200 m/min and 400 m/min.

18. The method according to claim 1, wherein said treatment phase is a dry phase wherein tumbling and drying are performed simultaneously.

19. The method according to claim 18, wherein said loop of fabric is dried in said treatment device to a predetermined final humidity.

20. An assembly for performing the method according to claim 1, wherein said treatment device comprises a cylindrical autoclave which is sealed on all sides and is air tight, said autoclave comprising a hermetically closable opening for introducing and removing said fabric within said autoclave, said assembly further comprising a transport device for said fabric within said autoclave, and a pressure source to increase and decrease the pressure within said autoclave.

21. The assembly according to claim 20, wherein said transport device comprises a driving element for said fabric.

22. The assembly according to claim 21, wherein said fabric is subjected to an angular deflection between 70° C. and 300° C. around said driving element.

23. The assembly according to claim 21, wherein said fabric is subjected to an angular deflection between 85° C. and 270° C. around said driving element.

24. The assembly according to claim 21, wherein said transport device comprises a nozzle perfused by a gaseous fluid.

25. The assembly according to claim 24, wherein said nozzle has the shape of a nozzle canal.

26. The assembly according to claim 24, further comprising an element for cloth folding of the fabric within said treatment device.

27. The assembly according to claim 26, wherein said transport device comprises at least one freely rotatable drum within said cylindrical autoclave, said drum comprising a casing and two axially adjacent drum halves separated at a distance from each other so that a casing of said drum has a gap along its entire surface.

28. The assembly according to claim 27, wherein said folding element is positioned within said treatment device so that during transport of said fabric in said treatment device said fabric is fed through said gap into an inner part of said drum and is folded there.

29. The assembly according to claim 27, wherein said treatment device contains up to eight drums.

30. The assembly according to claim 27, wherein said treatment device contains 2 to 4 drums.

31. The assembly according to claim 24, further comprising a feeding system containing a ventilator, said feeding system being connected to said nozzle for feeding said gaseous fluid to said nozzle.

32. The assembly according to claim 31, wherein said feeding system is connected to said treatment device for recycling said gaseous fluid through said nozzle.

33. The assembly according to claim 32, further comprising a filter, a draining duct with a first valve, and an adduct with a second valve.

34. The assembly of claim 33 further comprising a heat exchanger.

35. The assembly according to claim 33, further comprising a second feeding system including a pump for the transport of fluids and a filter.

36. The assembly according to claim 35, further comprising a heat exchanger for said second feeding system.

37. The assembly according to claim 20, wherein said driving element comprises a driven reel and at least one driving roller, or at least one pair of driving rollers.

38. The assembly according to claim 1, wherein said treatment device further comprises a heating device.

* * * * *